US006848386B1

(12) United States Patent
Gieseke

(10) Patent No.: US 6,848,386 B1
(45) Date of Patent: Feb. 1, 2005

(54) UNDERWATER WEAPON SYSTEM HAVING A ROTATABLE GUN

(75) Inventor: Thomas J. Gieseke, Newport, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/730,184

(22) Filed: Dec. 8, 2003

(51) Int. Cl.[7] ..... B63G 8/30
(52) U.S. Cl. ..... 114/316; 114/8; 89/38
(58) Field of Search ..... 42/1.14; 89/5, 89/38; 114/316–320, 5–7, 9, 175, 8

(56) References Cited

U.S. PATENT DOCUMENTS

| | | | | |
|---|---|---|---|---|
| 1,303,266 A | * | 5/1919 | Dougan | 114/316 |
| 1,349,414 A | | 8/1920 | Dougan | |
| 1,781,175 A | | 11/1930 | Grieshaber | |
| 2,979,015 A | | 4/1961 | Estes | |
| 3,474,750 A | | 10/1969 | Bleu | |
| 3,587,504 A | * | 6/1971 | Kearney, II | 114/6 |
| 3,774,564 A | | 11/1973 | Bondon et al. | |
| 3,990,035 A | | 11/1976 | Byers | |
| 4,132,974 A | * | 1/1979 | Mollere | 367/15 |
| 4,262,621 A | | 4/1981 | Tolkiehn et al. | |
| 4,975,543 A | | 12/1990 | Saunders | |
| 6,044,038 A | * | 3/2000 | Allensworth | 367/16 |

FOREIGN PATENT DOCUMENTS

| | | | |
|---|---|---|---|
| FR | 2 688 466 A1 | * | 9/1993 |
| GB | 2 177 352 A | * | 1/1987 |

* cited by examiner

*Primary Examiner*—Stephen M. Johnson
(74) *Attorney, Agent, or Firm*—James M. Kasischke; Michael P. Stanley; Jean-Paul Nasser

(57) ABSTRACT

An underwater weapon system having a housing formed by first and second halves thereof sandwiched about a gun system that is rotatably mounted to and between the first and second halves. The gun system includes a gun and ammunition sealed within a waterproof housing with a muzzle of the gun protruding from the waterproof housing. The gun system is rotatable relative to the first and second halves of the housing while the housing can be maneuvered to rotate through a plane of rotation of the gun system as the housing moves through the water.

10 Claims, 2 Drawing Sheets

UNDERWATER WEAPON SYSTEM HAVING A ROTATABLE GUN

STATEMENT OF GOVERNMENT INTEREST

The invention described herein may be manufactured and used by or for the Government of the United States of America for Governmental purposes without the payment of any royalties thereon or therefore.

BACKGROUND OF THE INVENTION (1) Field of the Invention

The present invention relates generally to underwater weapons systems, and more particularly to an underwater weapon system having a rotating gun system mounted in a vehicle housing.

(2) Description of the Prior Art

Underwater gun systems are being developed for use as anti-mine and anti-torpedo applications. The basic systems include an underwater gun, underwater projectiles, a ship-mounted turret supporting the underwater gun, a targeting system and a combat system. The underwater gun shoots the underwater projectiles which are specially designed for neutralization of undersea targets at ranges of 200 meters or more. The undersea targets are identified and localized with the targeting system, and the combat system provides the control commands to direct the ship-mounted turret to aim the gun towards the target.

Currently, underwater gun systems are mounted onboard a conventional ship by means of a retractable gun turret that deploys a rotating gun using a large hydraulic actuator. The gun is stored in a bay having a hatch on the bottom of the ship that can be opened to allow the turret and gun to be deployed therethrough. When deployed, the gun turret is not readily faired thereby causing drag that results in substantial hydrodynamic loads on the deployed turret and the host ship. Furthermore, for the gun system to respond in a rapid fashion to an unexpected threat, the gun system must be continuously deployed thereby subjecting the host ship to long-term hydrodynamic loads while also reducing the value of having a retractable system. Still further, the space required onboard the host ship is considerable, e.g., the length required for a retractable turret can exceed ten meters for a gun that fires 30 millimeter caliber rounds.

SUMMARY OF THE INVENTION

Accordingly, it is a general purpose and primary object of the present invention to provide an underwater weapon system that can be continuously deployed without substantially impacting the operation of a ship that the weapon system is tasked to protect.

It is a further object of the present invention to provide an underwater weapon system that can be maneuvered to engage an underwater target in any direction relative thereto.

Other objects and advantages of the present invention will become more obvious hereinafter in the specification and drawings.

To obtain the objects described, an underwater weapon system having a vehicle housing is defined by a first portion and a second portion spaced apart from one another. Each vehicle housing portion has an exterior configured to provide hydrodynamic position control. The first and second vehicle housing portions are used cooperatively to alter a position of the vehicle housing in the water as the vehicle housing moves therethrough (e.g., via towing or attached propulsors).

A gun system is rotatably mounted to and between the first and second vehicle housing portions at an axis of rotation. The gun system includes a gun and ammunition sealed within a waterproof housing with a muzzle of the gun protruding from the waterproof housing. As a result, the muzzle can discharge ammunition therefrom into the water between the first and second vehicle housing portions. The gun system is also rotatable relative to the first and second vehicle housing portions to a position where the muzzle is positioned to fire ammunition towards an underwater target.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DESCRIPTION OF THE PREFERRED EMBODIMENT(S)

Figure 1:
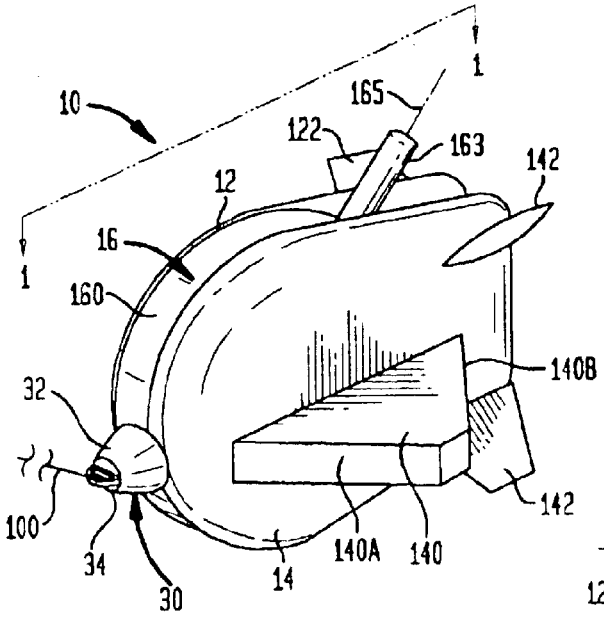
FIG. 1 is a perspective view of a towable underwater weapon system in accordance with one embodiment of the present invention.

Referring now to the drawings, simultaneous reference will be made to FIGS. 1 and 2 wherein one embodiment of an underwater weapon system in accordance with the present invention is shown and is referred generally by numeral 10. As explained below, the underwater weapon system 10 is a towable system designed to be pulled behind a host vessel (not shown). However, as will also be explained below, the present invention can be implemented as a self-propelled system and is not limited to use as a towed system.

The underwater weapon system 10 has first and second housing portions 12 and 14 that can be mated to form a vehicle housing that can be maneuvered through the water. The housing portions 12 and 14 are separated from one another and have a gun system 16 coupled thereto and therebetween such that the gun system 16 is rotatable relative to the housing portions 12 and 14 about an axis of rotation 18 defined by dashed line. More specifically, the gun system 16 is coupled to each of housing portions 12 and 14 by a hub 20 that will typically be motorized to permit controlled rotation of the gun system.

The gun system 16 has a waterproof housing 160 that encases an underwater gun 162 with a length of a muzzle 163 extending from the waterproof housing 160. The waterproof housing 160 also encases ammunition 164 for the underwater gun 162. It is to be understood that the ammunition 164 includes both the stowage of the ammunition (i.e., a magazine) and a supplying structure for the ammunition (i.e., a feed system) to the gun 162. Such a gun magazine and feed systems are well known in the art and will, therefore, not be described further herein.

The underwater gun 162 includes the muzzle 163 that protrudes from the waterproof housing 160 with the muzzle encompassing a bore axis 165. Thus, the gun system 16 rotating about the hub 20 provides for the rotation of the muzzle 163/bore axis 165. The underwater gun 162 can be positioned such that its bore axis 165 is aligned with the axis of rotation 18 of the gun system 16. However, in some situations, it may be desirable to have the bore axis 165 offset from the axis of rotation 18. In either case, the gun system 16 is rotatable about the hub 20 to a position that points the bore axis 165 towards an underwater target.

The gun system 16 can be rotated in its plane of rotation depicted by dashed line 22. However, to fire at targets out of plane 22, the underwater weapon system 10 must be able to rotate itself through the plane 22 as indicated by two-headed directional arrow 24. Such a rotation of the underwater weapon system 10 is made possible by the combination of: (i) wings 120 and 140 extending out, respectively, from the housing portions 12 and 14, and (ii) movable control surfaces 122 and 142 extending out, respectively, from the housing portions. The particular shape, size and number of wings 120/140 and control surfaces 122/142 can be varied without departing from the scope of the present invention.

In operation, as the underwater weapon system 10 moves through the water, the control surfaces 122/142 and wings 120/140 cooperate to allow the underwater weapon system 10 to rotate through plane 22.

In addition, the shape of the housing portions 12 and 14 can be configured to contribute to the maneuverability of the underwater weapon system 10. For example, each of the housing portions 12 and 14 can themselves define wings that are transverse to the wings 120 and 140. Furthermore, the housing portions 12 and 14 can be formed as mirror-images relative to the plane 22 so that a hydrodynamically balanced vehicle housing is defined thereby.

With the gun system 16 able to rotate about the hub 20 while the underwater weapon system 10 is able to rotate through the plane 22, the gun 162 can engage targets at any spherical position relative to the underwater weapon system.

Figure 2:
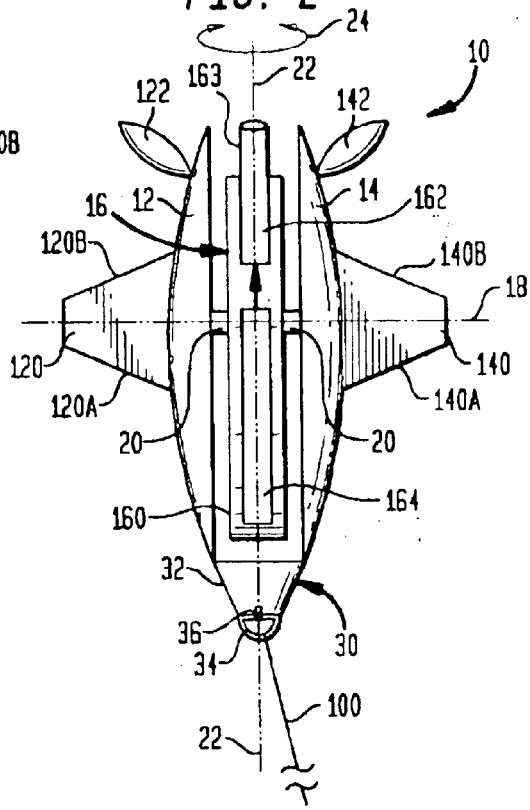
FIG. 2 is a partial plan view of the towable underwater weapon system with the view taken from the reference line 1—1 of FIG. 1 and a portion of the waterproof housing removed for clarification purposes.

In terms of the towed embodiment depicted in FIGS. 1 and 2, a swiveling tow couple 30 is mounted to underwater weapon system 10. The tow couple 30 provides a point of attachment for a tow cable 100 (e.g., a strength and, if needed, a signal/power carrying cable) coupled to a host ship (not shown) while simultaneously allowing the underwater weapon system 10 to freely rotate through the plane 22. Accordingly, the tow couple 30 includes a frame 32 attached partially to each of the housing portions 12 and 14, and a swivel 34 rotatably coupled to the frame 32 by coupling means such as a pin 36. The swivel 34 is aligned such that its axis of rotation is coincident with the plane 22.

While the wings 120 and 140 contribute to the hydrodynamic maneuverability of the underwater weapon system 10, the wings can also be configured to provide support platforms for sensors used by targeting and/or combat systems that can be included onboard the underwater weapon system. For example, in the illustrated embodiment, each of the wings 120 and 140 can be V-shaped with: (i) forward-facing surfaces 120A/140A disposed at a substantially forward facing angle relative to the plane 22, and (ii) rearward-facing surfaces 120B/140B disposed at a substantially rearward facing angle relative to the plane 22. Active or passive sonar arrays (not shown in FIGS. 1 and 2 for clarity of illustration) can be placed on each of the surfaces 120A/120B and 140A/140B, respectively, thereby forming forward and aft looking sonar on both sides of the underwater weapon system 10.

Figure 3:
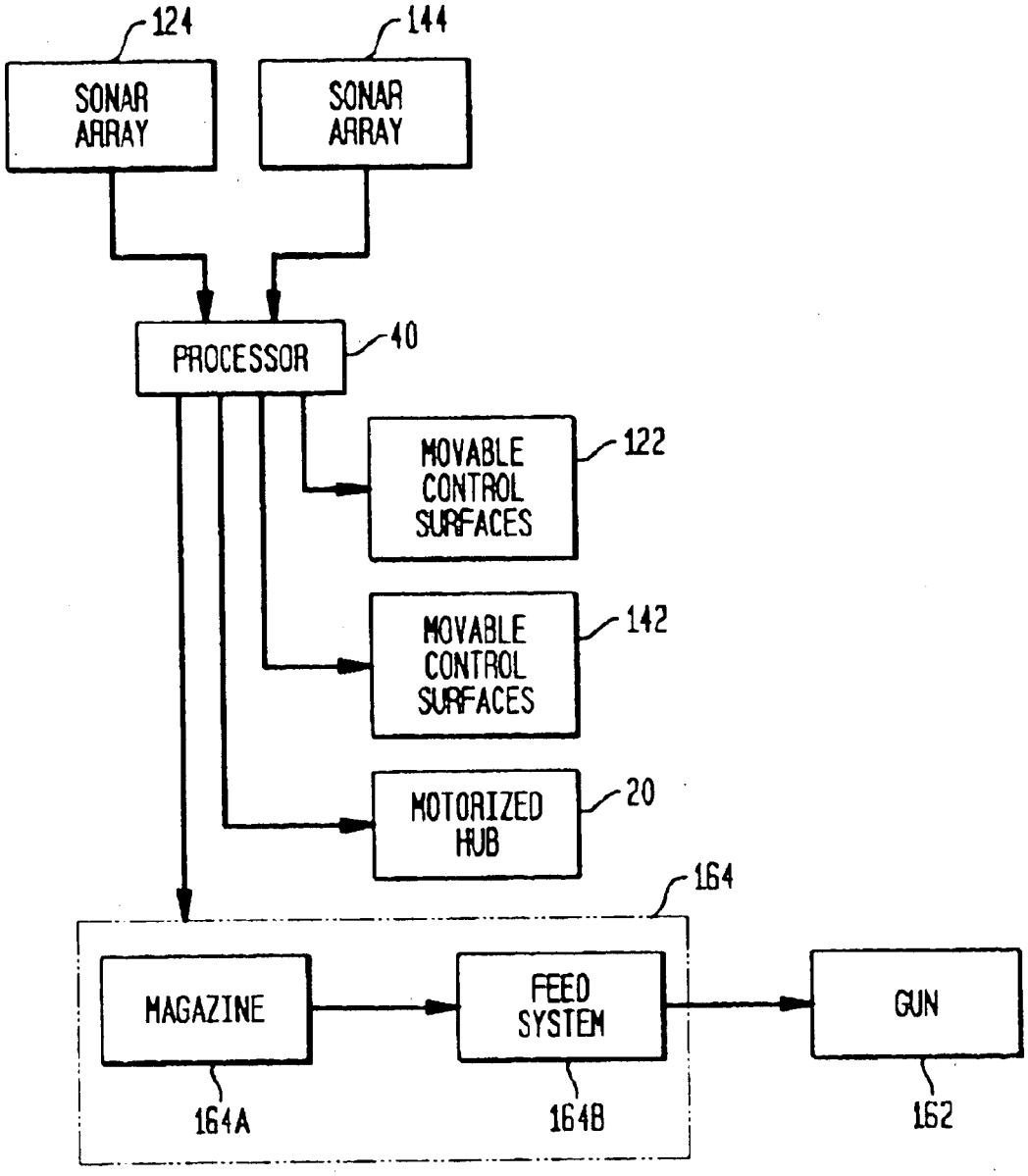
FIG. 3 is a block diagram of the functional elements of the towable underwater weapon system.

Referring now to FIG. 3 for the operation of the underwater weapon system 10, the outputs from sonar arrays 124 and 144 (mounted on surfaces 120A, 120B, 140A and 140B) are supplied to an on-board processor 40 for target identification and localization. Such processing is well understood in the art and will, therefore, not be addressed further herein.

Once a target has been identified/localized, the processor 40 sends control signals to the movable control surfaces 122 and 142. In this way, the housing portions 12 and 14 can rotate through the plane 22 to a desired position as they are towed through the water. At the same time, the processor 40 sends control signals to the motorized hub 20 in order to rotate it about the axis 18 until the muzzle 163/bore axis 165 achieves a desired aim point. Once the gun 162 is aimed, the magazine 164A and feed system 164B of the ammunition 164 supply underwater projectiles to the gun 162.

Figure 4:
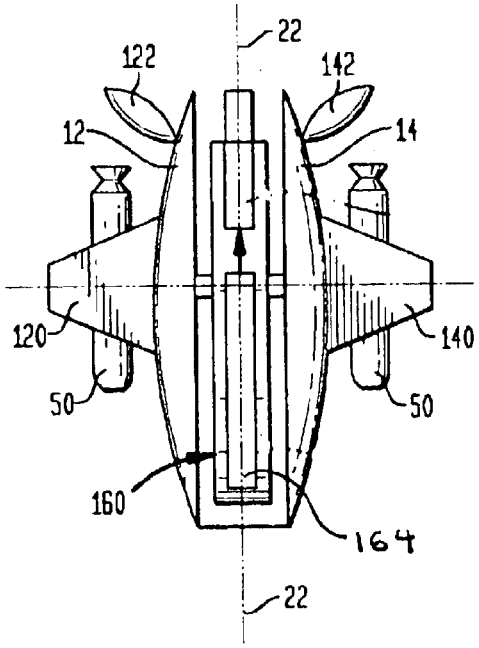
FIG. 4 is a partial plan view of a self-propelled underwater weapon system in accordance with another embodiment of the present invention with a portion of the waterproof housing removed for clarification purposes.

As mentioned above, the present invention is not limited to use as a towable vehicle. Accordingly, FIG. 4 illustrates another embodiment of the present invention in which propulsors 50 are coupled to each of the vehicle housing portions 12 and 14. The number of propulsors used and their positioning relative to the vehicle housing portions 12 and 14 are not limitations of the present invention. It is noted that the tow couple 30 (FIGS. 1 and 2) can be eliminated in this embodiment of the present invention.

The advantages of the present invention are numerous. The underwater weapon system integrates a continuously-deployed underwater gun into a towable or self-propelled platform that can be maneuvered such that the gun can be aimed at any target in a spherical region about the gun. This provides a host ship with "on demand" protection without impacting the host ship's hydrodynamics.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A weapon system suitable for an underwater environment, said weapon system comprising:

a vehicle housing defined by a first portion and a second portion spaced apart from one another wherein said first and second portions are each configured to include a fixed wing and a plurality of movable control surfaces capable of maneuvering said weapon system;

a swivelable tow coupling mounted to said vehicle housing wherein the swiveling action of said tow coupling stabilizes the position of said weapon system;

a gun system sealed within a waterproof housing, said gun system including a gun with a muzzle of said gun protruding from said waterproof housing, said gun system rotatably mounted to and between said first portion and said second portion at an axis of rotation; and means for rotating said gun system to a position to fire said gun at a target.

2. The weapon system in accordance with claim 1 further comprising means for searching for the target and controlling said gun system to fire at the target.

3. The weapon system in accordance with claim 1 further comprising means for propulsion.

4. The weapon system in accordance with claim 3 further comprising means for searching for the target and controlling said gun system to fire at the target.

5. A weapon system suitable for an underwater environment, said weapon system comprising:

a vehicle housing defined by first and second halves that are spaced apart from one another, said first and second halves balanced to each other as mirror images of one another with respect to an imaginary plane that passes therebetween, wherein the balance of said first and second halves allows said vehicle housing to move through the water in a direction substantially aligned with the imaginary plane;

a swivelable tow couple mounted to said vehicle housing and centered on the imaginary plane wherein the swiveling action of said tow coupling stabilizes the position of said weapon system;

a gun system including a gun and ammunition sealed within a waterproof housing with a muzzle of said gun protruding from said waterproof housing, said gun system being rotatably mounted to and between said first and second halves of said vehicle housing at an axis of rotation, wherein said muzzle can discharge said ammunition therefrom into the water; and means for rotating said gun system relative to said first and second halves of said vehicle housing to a position where said muzzle is positioned to fire said ammunition towards an underwater target.

6. The weapon system in accordance with claim 5 wherein each exterior of said first and second halves of said vehicle housing is configured to include:

a V-shaped fixed wing having a substantially forward-facing surface and a substantially aft-facing surface; and a plurality of movable control surfaces capable of maneuvering said weapon system.

7. The weapon system in accordance with claim 6 wherein said weapon system further includes:

a sensing means coupled to each of said substantially forward-facing surfaces and said substantially aft-facing surfaces; and a processing means coupled and responsive to said sensing means such that said weapon system searches for the underwater target and determines the position for said gun system to fire at the underwater target.

8. The weapon system in accordance with claim 5 further comprising means for propulsion coupled to each of said first and second halves.

9. The weapon system in accordance with claim 8 wherein each exterior of said first and second halves of said vehicle housing is configured to include:

a V-shaped fixed wing having a substantially forward-facing surface and a substantially aft-facing surface; and a plurality of movable control surfaces capable of maneuvering said weapon system.

10. The weapon system in accordance with claim 9 wherein said said weapon system further includes:

a sensing means coupled to each of said substantially forward-facing surfaces and said substantially aft-facing surfaces; and a processing means coupled and responsive to said sensing means such that said weapon system searches for the underwater target and determines the position for said gun system to fire at the underwater target.

* * * * *